US009065165B2

(12) United States Patent
Wong et al.

(10) Patent No.: US 9,065,165 B2
(45) Date of Patent: Jun. 23, 2015

(54) COMMUNICATION DEVICE AND RECONFIGURABLE ANTENNA ELEMENT THEREIN

(71) Applicant: Acer Incorporated, New Taipei (TW)

(72) Inventors: Kin-Lu Wong, Kaohsiung (TW); Yi-Ting Hsieh, Kaohsiung (TW)

(73) Assignee: Acer Incorporated, New Taipei (TW)

( * ) Notice: Subject to any disclaimer, the term of this patent is extended or adjusted under 35 U.S.C. 154(b) by 198 days.

(21) Appl. No.: 13/747,490

(22) Filed: Jan. 23, 2013

(65) Prior Publication Data

US 2014/0145900 A1 May 29, 2014

(30) Foreign Application Priority Data

Nov. 28, 2012 (TW) ..... 101144538 A

(51) Int. Cl.

| | |
|---|---|
| ***H01Q 1/50*** | (2006.01) |
| ***H01Q 7/00*** | (2006.01) |
| ***H01Q 1/24*** | (2006.01) |
| ***H01Q 9/42*** | (2006.01) |

(52) U.S. Cl.
CPC . *H01Q 7/00* (2013.01); *H01Q 1/50* (2013.01); *H01Q 1/243* (2013.01); *H01Q 9/42* (2013.01)

(58) Field of Classification Search
CPC ..... H01Q 1/243; H01Q 9/42; H01Q 1/50; H01Q 7/00; H01Q 5/0037
USPC ..... 343/700 MS, 702, 866, 876, 848, 860
See application file for complete search history.

(56) References Cited

U.S. PATENT DOCUMENTS

| | | | | |
|---|---|---|---|---|
| 7,307,591 | B2 * | 12/2007 | Zheng | 343/702 |
| 7,420,511 | B2 * | 9/2008 | Oshiyama et al. | 343/700 MS |
| 8,699,964 | B2 * | 4/2014 | Ohba et al. | 455/77 |
| 2004/0227678 | A1 | 11/2004 | Sievenpiper | |
| 2006/0097918 | A1 | 5/2006 | Oshiyama et al. | |
| 2009/0251383 | A1 * | 10/2009 | Tani et al. | 343/852 |
| 2013/0257679 | A1 * | 10/2013 | Wong et al. | 343/876 |

FOREIGN PATENT DOCUMENTS

| | | |
|---|---|---|
| EP | 2048739 | 4/2009 |
| JP | 2004253943 | 9/2004 |

* cited by examiner

*Primary Examiner* — Tan Ho
(74) *Attorney, Agent, or Firm* — Jianq Chyun IP Office

(57) ABSTRACT

A communication device including a ground element, an antenna element and a switching unit is provided. The antenna element is substantially a loop antenna and includes a first part, a second part and a third part. The second part includes (N−1) bends for forming N connection sections. The third part includes (P−1) bends for forming P ground sections. The N connection sections are connected in series between a first end of a first ground section and the first part. A second end of an $i^{th}$ ground section is electrically connected to a first end of an $(i+1)^{th}$ ground section, i is an integer and $1 \le i \le (P-1)$. A second end of a $P^{th}$ ground section is electrically connected to the ground element, and a $(P-1)^{th}$ ground section includes at least one ground point. The switching unit is electrically connected between the at least one ground point and the ground element.

10 Claims, 6 Drawing Sheets

COMMUNICATION DEVICE AND RECONFIGURABLE ANTENNA ELEMENT THEREIN

CROSS-REFERENCE TO RELATED APPLICATION

This application claims the priority benefit of Taiwan application serial no. 101144538, filed on Nov. 28, 2012. The entirety of the above-mentioned patent application is hereby incorporated by reference herein and made a part of this specification.

BACKGROUND OF THE INVENTION

1. Field of the Invention

The invention relates to a communication device and particularly to a communication device having a reconfigurable antenna element.

2. Description of Related Art

With rapid developments of wireless technology, communication devices are no longer devices simply used by people to call each other. Additional functions and diversified features for communication devices are also strongly demanded by people. In order to satisfy such demands, cell phones must accommodate more elements and modules. Given that a communication device is designed to be thinner and lighter, the inner space of the communication device would also be limited. Therefore, a proper design for the antenna to fit in limited space within a communication device is extremely important. Accordingly, when it comes to designing an antenna for a communication device, utilizing the limited space to accommodate the antenna becomes an important issue.

SUMMARY OF THE INVENTION

The invention is directed to a communication device having a reconfigurable antenna element adapted to adjust a resonant path length by using a switching unit, so as to achieve multiband operation for an antenna element.

A communication device including a ground element, an antenna element and a switching unit is provided. The antenna element is substantially a loop antenna and includes a first part, a second part and a third part. The first part is electrically connected to a signal source. The second part including (N−1) bends for forming N connection sections, wherein N is an integer greater than 1. The second part including (P−1) bends for forming P ground sections, wherein P is an integer greater than 1. The N connection sections are connected in series between a first end of a first ground section and the first part. A second end of an $i^{th}$ ground section is electrically connected to a first end of an $(i+1)^{th}$ ground section, wherein i is an integer and $1 \le i \le (P-1)$. A second end of a $P^{th}$ ground section is electrically connected to the ground element, and a $(P-1)^{th}$ ground section includes at least one ground point. The switching unit is electrically connected between the at least one ground point and the ground element.

In one embodiment of the invention, the at least one ground point include M ground points and the switching unit includes M switches, wherein M is a positive integer. A first end of a $j^{th}$ switch is electrically connected to a $j^{th}$ ground point, and second ends of the M switches are electrically connected to the ground element, wherein j is an integer and $1 \le j \le M$.

In light of the foregoing, the invention may adjust a resonant path length by using a switching unit. Accordingly, additional operating bands of the antenna element may be obtained without modifying a size of the antenna element.

Moreover, the higher-frequency resonant modes of the antenna element will not be affected by the switching unit, substantially.

To make the above features and advantages of the invention more comprehensible, several embodiments accompanied with drawings are described in detail as follows.

BRIEF DESCRIPTION OF THE DRAWINGS

FIG. 2A is a diagram used to illustrate a return loss of the antenna element under the circumstance when none of two switches is turned on.

FIG. 2B is a diagram used to illustrate a return loss of the antenna element under the circumstance when one of two switches is turned on.

FIG. 2C is a diagram used to illustrate a return loss of the antenna element under the circumstance when another one of two switches is turned on.

DESCRIPTION OF THE EMBODIMENTS

Figure 1:
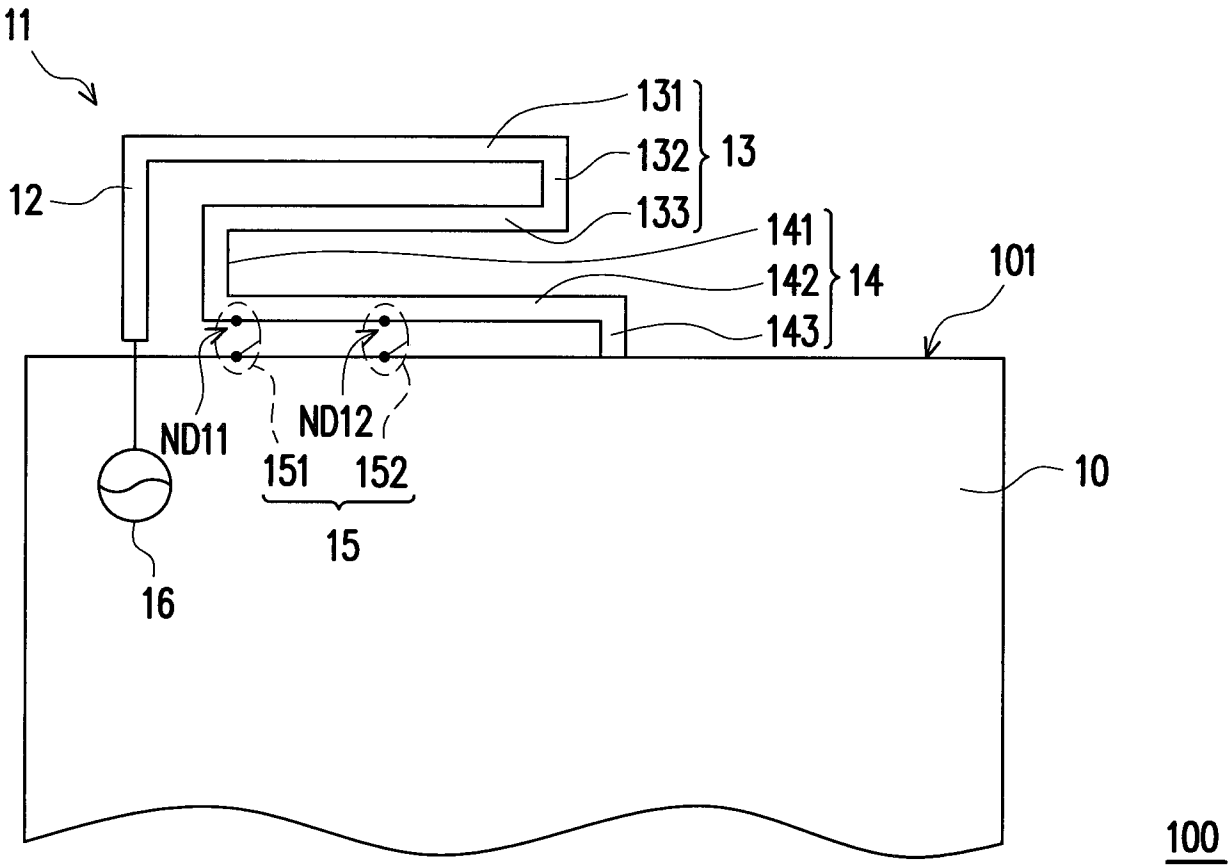
FIG. 1 is a schematic view illustrating a structure of a communication device according to a first embodiment of the invention.

FIG. 1 is a schematic view illustrating a structure of a communication device according to a first embodiment of the invention. A communication device 100 includes a ground element 10, an antenna element 11 and a switching unit 15. The antenna element 11 is substantially a loop antenna and is adjacent to the ground element 10. In addition, the antenna element 11 includes a first part 12, a second part 13 and a third part 14. The first part 12 of the antenna element 11 is electrically connected to a signal source 16.

According to the present embodiment, the second part 13 has two bends for forming three connection sections 131-133. Similarly, the third part 14 also has two bends for forming three ground sections 141-143. The connection sections 131-133 are connected in series between a first end of a first ground section 141 and the first part 12. A total length of a first connection section 131 and a third connection section 133 is greater than a total length of the three ground sections 141-143. Furthermore, a second end of a first ground section 141 is electrically connected to a first end of a second ground section 142. A second end of a second ground section 142 is electrically connected to a first end of a third ground section 143, and a second end of the third ground section 143 is electrically connected to the ground element 10.

In addition, odd numbered connection sections 131 and 133 in the three connection sections 131-133 are substantially parallel to an edge 101 of the ground element 10, and an even numbered connection section 132 in the three connection sections 131-133 is substantially vertical to the edge 101 of the ground element 10. On the other hand, an even numbered connection section 142 in the three ground sections 141-143 is also substantially parallel to the edge 101 of the ground element 10, and odd numbered ground sections 141 and 143 in the three ground sections 141-143 are also substantially vertical to the edge 101 of the ground element 10. Further, the second ground section 142 includes a ground point ND11 and a ground point ND12, and the ground points ND11 and ND12 are sequentially arranged along a direction towards the third ground section 143.

More particularly, the switching unit 15 includes switches 151 and 152. A first end of the switch 151 is electrically connected to the ground point ND11, and a second end of the switch 151 is electrically connected to the ground element 10. In addition, a first end of the switch 152 is electrically connected to the ground point ND12, and a second end of the switch 152 is electrically connected to the ground element 10. During the operation, the communication device 100 transmits a corresponding control signal to the switches 151 and 152 so as to switch the states of the switches 151 and 152.

In addition, by changing the states of the switches 151 and 152, the two ground points ND11 and ND12 on the second connection section 142 may be electrically connected to the ground element device 10 through the switches 151 and 152. For instance, the ground point ND11 may be electrically connected to the ground element 10 through the switch 151 when the switch 151 is turned on. Similarly, the ground point ND12 may be electrically connected to the ground element 10 through the switch 152 when the switch 152 is turned on. Base on the above, by changing states of the switches 151 and 152, a resonant path length of the antenna element is changed accordingly so as to enable the antenna element 10 to operate in different operating bands.

Moreover, since the third part 14 is located at an end of the antenna element 11, a current null of a higher-frequency resonant mode of the antenna element 11 will not appear on the third part 14. As the result, the higher-frequency resonant mode of the antenna element 11 may not be affected by operations of the switches 151 and 152. In other words, the antenna element 11 has a reconfigurable structure, and the reconfigurable structure is mainly controlled by the switching unit 15 in the communication device 100. In addition, the communication device 100 may adjust a lower-frequency resonant mode of the antenna element 11 through the reconfigurable structure. Accordingly, an operating band of the antenna element 11 may be adjusted without modifying a size of the antenna element 11. Moreover, the higher-frequency resonant mode of the antenna element 11 will not be affected by the switching unit 15, substantially.

Figure 2A:
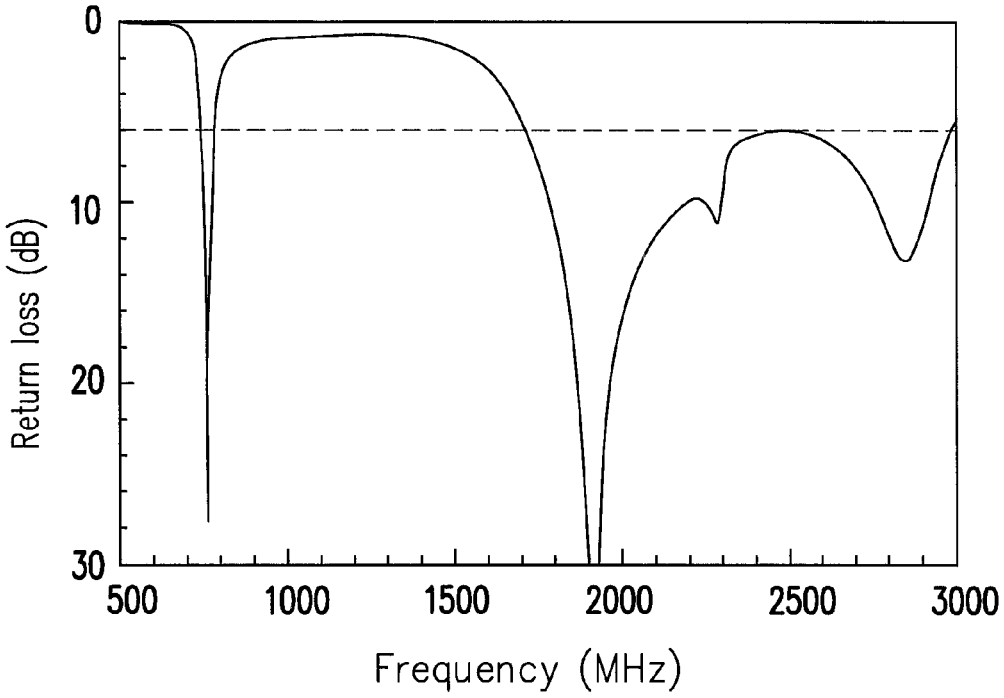

For instance, FIG. 2A is a diagram illustrating a return loss of the antenna element under the circumstance when none of two switches is turned on. In the above-said operating condition, the two switches 151 and 152 are both turned off, that is, the two ground points ND11 and ND12 cannot be electrically connected to the ground element 10 through the switches 151 and 152, respectively. In this case, the resonant path length of entire loop antenna is approximately 80 mm. In addition, a lower-frequency operating band of the antenna element 11 may cover LTE700 band, and a higher-frequency operating band of the antenna element 11 may cover GSM1800/1900/UMTS/LTE2300/2500 bands (approximately from 1710 MHz to 2690 MHz).

Figure 2B:
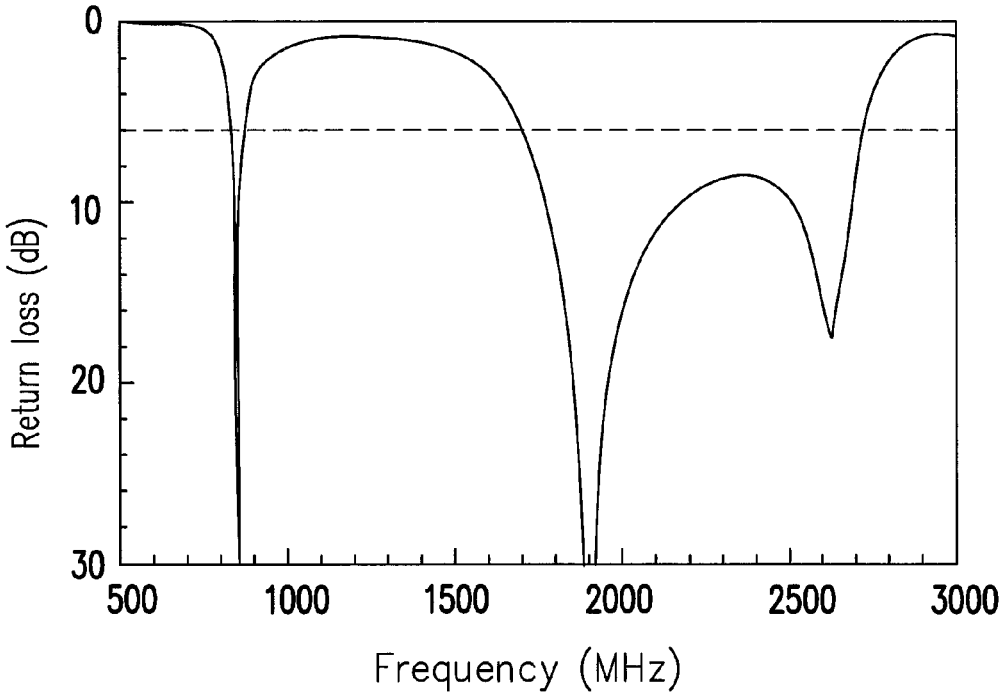

FIG. 2B is a diagram used to illustrate a return loss of the antenna element under the circumstance when one of two switches is turned on. In the above-said operating condition, the switch 151 is turned off, whereas the switch 152 is turned on. Accordingly, the ground point ND12 may be electrically connected to the ground element 10 through the switch 152. As a result, the resonant path length of entire loop antenna is reduced correspondingly, so as to adjust the lower-frequency operating band of the antenna element 11 to GSM850 band. In addition, the higher-frequency resonant mode of the antenna element 11 may not be affected by the operations of the switches 151 and 152, substantially. That is, the higher-frequency operating band of the antenna element 11 may still cover GSM1800/1900/UMTS/LTE2300/2500 bands.

Figure 2C:
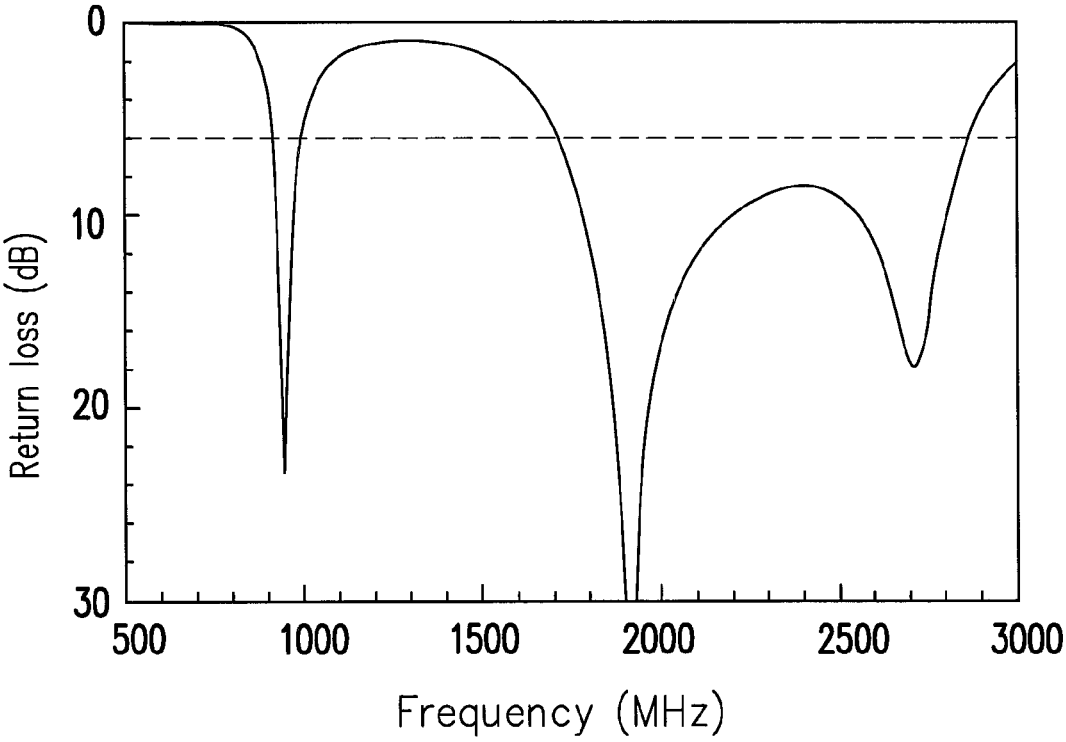

FIG. 2C is a diagram used to illustrate a return loss of the antenna element under the circumstance when another one of two switches is turned on. In the above-said operating condition, the switch 151 is turned on, whereas the switch 152 is turned off. Accordingly, the ground point ND11 may electrically connect to the ground element 10 through the switch 151. As the result, the resonant path length of the loop antenna is reduced correspondingly so that the lower-frequency operating band of the antenna element 11 is adjusted to GSM900 band. In addition, the higher-frequency resonant mode of the antenna element 11 may not be affected by the operations of the switches 151 and 152, substantially. That is, the higher-frequency operating band of the antenna element 11 may still cover GSM1800/1900/UMTS/LTE2300/2500 bands.

Figure 3:
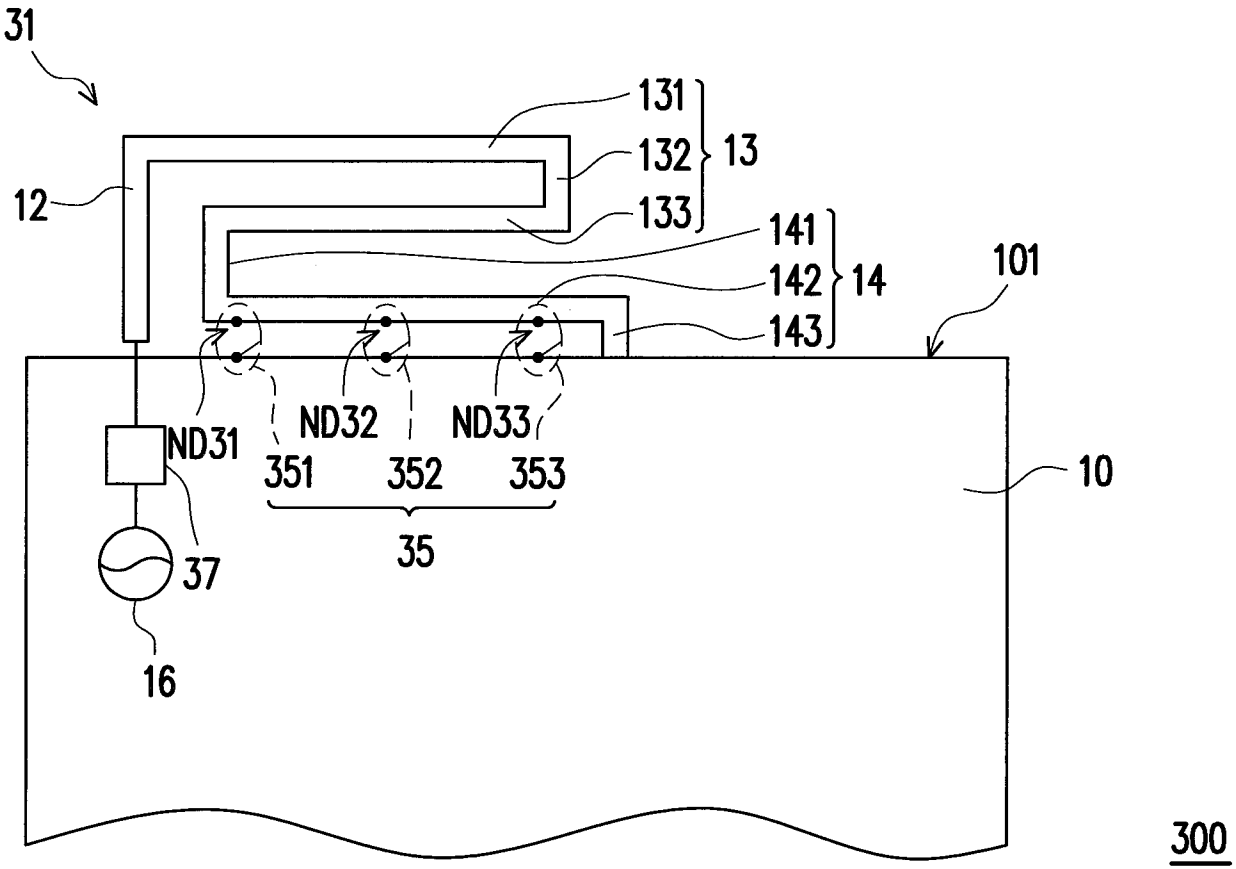
FIG. 3 is a schematic view illustrating a structure of a communication device according to a second embodiment of the invention.

FIG. 3 is a schematic view illustrating a structure of a communication device according to a second embodiment of the invention. The second embodiment is similar to the first embodiment, and one of the major differences between the two embodiments is that in the second embodiment, a communication device 300 further includes a matching circuit 37. In addition, the second ground section 141 of the antenna element 31 includes three ground points ND31-ND33, and the switching unit 35 includes three switches 351-353.

More specifically, the matching circuit 37 is disposed between the first part 12 and the signal source 16, so that the first part 12 is electrically connected to the signal source 16 through the matching circuit 37. As the result, an impedance matching for the antenna element 31 in both the lower-frequency operating band and the higher-frequency operating band may be improved. In addition, a first end of the switch 351 is electrically connected to the ground point ND31, and a second end of the switch 351 is electrically connected to the ground element 10. A first end of the switch 352 is electrically connected to the ground point ND32, and a second end of the switch 352 is electrically connected to the ground element 10. A first end of the switch 353 is electrically connected to the ground point ND33, and a second end of the switch 353 is electrically connected to the ground element 10. Further, the ground point ND32 is located between the ground point ND31 and the ground point ND33.

During the operation of the communication device 300, the communication device 300 may adjust the resonant path length of the antenna element 31 by switching the states of the switches from 351-353 so as to achieve similar effect as described in the first embodiment. In addition, a person of ordinary skill in the art may change the number of the ground points and the number of the switches according to the design requirements based on the spirit and teachings from the first and the second embodiments. In other words, in the case when the numbers of the ground points and the switches are represented by M, the second ground point 142 may include M ground points and the switching unit 15 may include M switches, and M is a positive integer. In addition, a first end of a $j^{th}$ switch is electrically connected to a $j^{th}$ ground point, and second ends of the M switches are electrically connected to the ground element 10, wherein j is an integer and $1 \leq j \leq M$.

Figure 4:
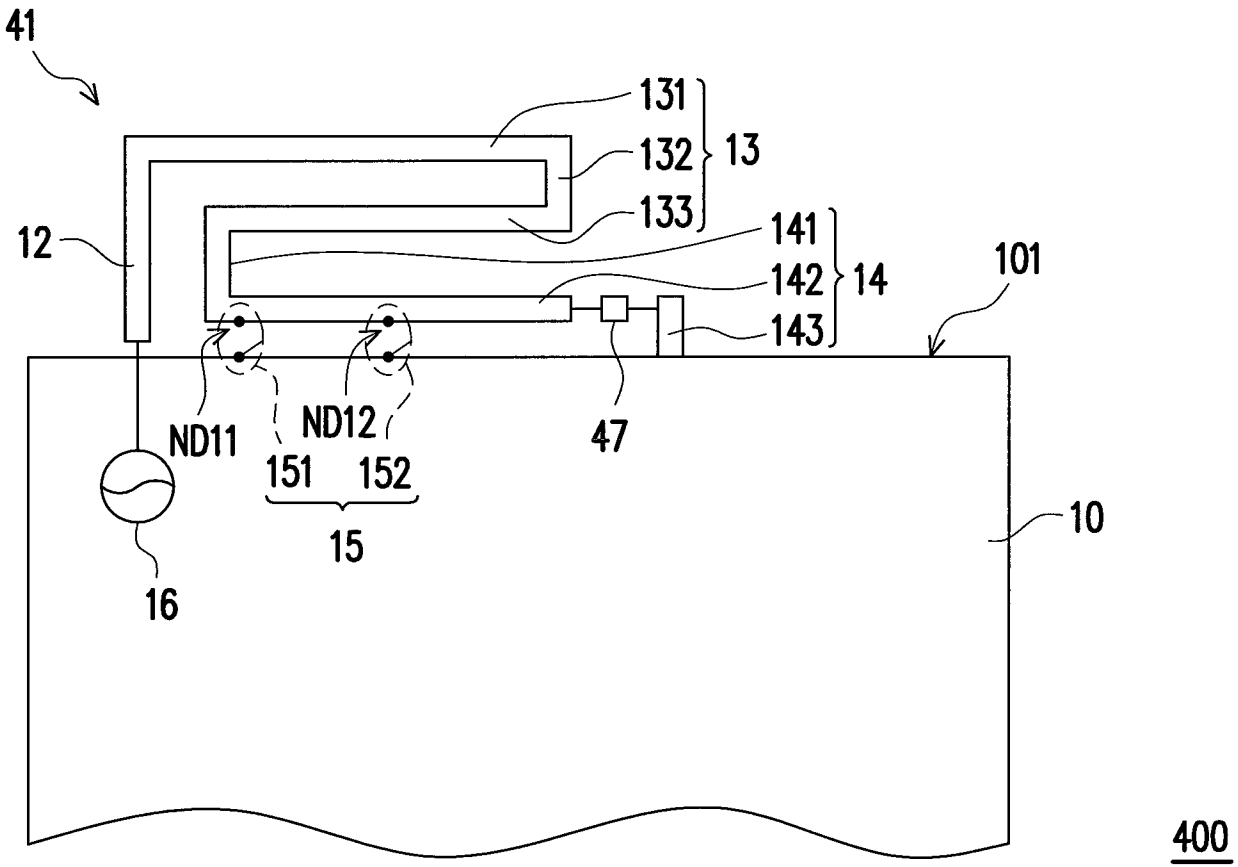
FIG. 4 is a schematic view illustrating a structure of a communication device according to a third embodiment of the invention.

FIG. 4 is a schematic view illustrating a structure of a communication device according to a third embodiment of the invention. The third embodiment is similar to the first embodiment, and one of the major differences between the two embodiments is that in the third embodiment, a communication device 400 further includes a reactance element 47. More specifically, the reactance element 47 is disposed between the second ground section 142 and the third ground section 143. The reactance element 47 may be a chip inductor or a chip capacitor. In addition, an equivalent length of an antenna element 41 may be extended or reduced by selecting different types of the reactance element 47 and by regulating an element value thereof, thereby replacing a part of the resonant path originally required so as to achieve similar effect as described in the first embodiment.

It should be noted that, although a layout structure of the antenna element 11 is exemplarily described in the first through the third embodiments, it is not construed as a limitation to the present invention. Hence, based on the design requirements, a person of ordinary skill in the art may change a number N of the connection sections in the second part 13 and a number P of the ground sections in the third part 14, wherein numbers N and P are integers greater than 1.

For instance, it is illustrated in the first through the third embodiments using N=P=3 as an example. In addition, according to the spirit and teachings from the first and the second embodiments, once the number of the connection sections and the number of the ground sections are represented respectively by N and P, the second part 13 may include N connection sections (e.g., 131-133) and the third part 14 may include P ground sections (e.g., 141-143). In addition, the N connection sections are connected in series between a first end of a first ground section and the first part. A second end of an $i^{th}$ ground section is electrically connected the a first end of an $(i+1)^{th}$ ground section and a second end of a $P^{th}$ ground section is electrically connected to the ground element, and i is an integer and $1 \leq i \leq (P-1)$. Moreover, a $(P-1)^{th}$ ground section (e.g., 142) includes at least one ground point. In addition, according to an embodiment, a total length of the N connection sections in the second part is greater than a total length of the P ground sections in the third part.

It should be noted that in the first through the third embodiment as described above, N is an odd number. Therefore, in regard to a detailed structure of the antenna element 11, odd numbered connection sections (e.g., 131 and 133) in the N connection sections and even numbered ground sections (e.g., 142) in the P ground sections are substantially parallel to an edge of the ground element 10. Further, based on actual applications, N may also be an even number. When N is the even number, in regard to the detailed structure of the antenna element 11, odd numbered connection sections in the N connection sections and odd numbered ground sections in the P ground sections are substantially parallel to an edge of the ground element.

Figure 5:
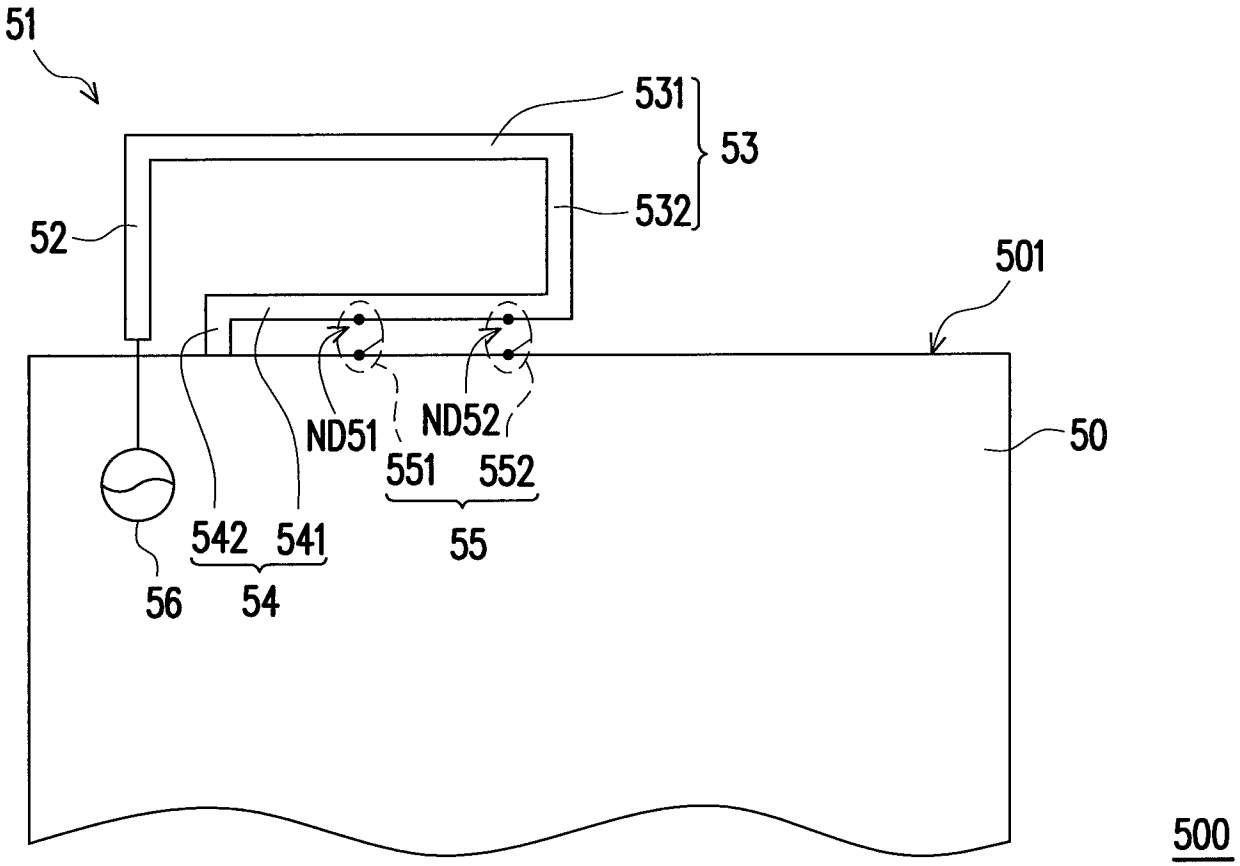
FIG. 5 is a schematic view illustrating a structure of a communication device according to a fourth embodiment of the invention.

For instance, FIG. 5 is a schematic view illustrating a structure of a communication device according to a fourth embodiment of the invention. Referring to FIG. 5, a communication device 500 includes a ground element 50, an antenna element 51 and a switching unit 55. The antenna element 51 includes a first part 52, a second part 53 and a third part 54. In the fourth embodiment, a number of sections is equal to 2. That is, the second part 53 has one bend for forming two connection sections 531 and 532, and the third part 54 also has one bends for forming two ground sections 541 and 542.

In addition, the first part 52 is electrically connected to a signal source 56. An odd numbered connection section 531 in the two connection sections 531 and 532 is substantially parallel to an edge 501 of the ground element 50, and an even numbered connection section 532 in the two connection sections 531 and 532 is substantially vertical to the edge 501 of the ground element 50. On the other hand, an odd numbered ground section 541 in the two ground sections 541 and 542 is also substantially parallel to the edge 501 of the ground element 50, and an even numbered ground section 542 in the two ground sections 541 and 542 is also substantially vertical to the edge 501 of the ground element 50. Further, a first ground section 542 includes ground points ND51 and ND52.

More particularly, the switching unit 55 includes switches 551 and 552. The first ends of the switches 551 and 552 are electrically connected to the ground points ND51 and ND52 respectively, and the second ends of the switches 551 and 552 are electrically connected to the ground element 50. During the operation, the communication 500 may adjust the resonant path length of the antenna element 51 by switching the states of the switches 551 and 552 so as to achieve similar effect as described in the first embodiment.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A communication device, comprising:

a ground element;

an antenna element being substantially a loop antenna and having a lower-frequency resonant mode and a higher-frequency resonant mode, the antenna element comprises:

a first part electrically connected to a signal source;

a second part comprising (N−1) bends for forming N connection sections, wherein N is an integer greater than 1; and a third part comprising (P−1) bends for forming P ground sections, wherein P is an integer greater than 1, the N connection sections are connected in series between a first end of a first ground section and the first part, a second end of an $i^{th}$ ground section is electrically connected to a first end of an $(i+1)^{th}$ ground section, a second end of a $P^{th}$ ground section is electrically connected to the ground element, and a $(P-1)^{th}$ ground section comprises at least one ground point, i is an integer and $1 \leq i \leq (P-1)$; and a switching unit electrically connected between the at least one ground point and the ground element and adjusting a resonant path length of the antenna element so as to adjust the lower-frequency resonant mode, wherein a current null of the higher-frequency resonant mode is not located at the third part of the antenna element.

2. The communication device of claim 1, wherein the at least one ground point comprises M ground points and M is a positive integer, the switching unit comprises:

M switches, wherein a first end of a $j^{th}$ switch is electrically connected to a $j^{th}$ ground point, and second ends of the M switches are electrically connected to the ground element, wherein j is an integer and $1 \leq j \leq M$, the switching unit changes a resonant path length of the antenna element by controlling states of the M switches.

3. The communication device of claim 1, wherein the at least one ground point comprises a first ground point and a second ground point, and the switching unit comprises:

a first switch and a second switch, the first switch is electrically connected between the first ground point and the ground element, and the second switch is electrically connected between the second ground point and the ground element;

wherein the first ground point is electrically connected to the ground element through the first switch when the first switch is turned on, the second ground point is electrically connected to the ground element through the second switch when the second switch is turned on, and the first ground point and the second ground point are electrically connected to the ground element through the second end of the $P^{th}$ ground section in the third part when none of the first switch and the second switch is turned on.

4. The communication device of claim 1, wherein the at least one ground point comprises a first ground point, a second ground point and a third ground point, the second ground point is located between the first ground point and the third ground point, and the switching unit comprises:

a first switch, a second switch and a third switch, wherein the first switch is electrically connected between the first ground point and the ground element, the second switch is electrically connected between the second ground point and the ground element and the third switch is electrically connected between the third ground point and the ground element, wherein the first ground point is electrically connected to the ground element through the first switch when the first switch is turned on, the second ground point is electrically connected to the ground element through the second switch when the second switch is turned on, the third ground point is electrically connected to the ground element through the third switch when the third switch is turned on, and the first ground point, the second ground point and the third ground point are electrically connected to the ground element through the second end of the $P^{th}$ ground section in the third part when none of the first switch, the second switch and the third switch is turned on.

5. The communication device of claim 1, wherein when N is an odd number, odd numbered connection sections in the N connection sections and even numbered ground sections in the P ground sections are substantially parallel to an edge of the ground element.

6. The communication device of claim 1, wherein when N is an even number, odd numbered connection sections in the N connection sections and odd numbered ground sections in the P ground sections are substantially parallel to an edge of the ground element.

7. The communication device of claim 1, further comprising:

a reactance element disposed between the $(P-1)^{th}$ ground section and the $P^{th}$ ground section.

8. The communication device of claim 7, wherein the reactance element is a chip inductor or a chip capacitor.

9. The communication device of claim 1, wherein a total length of the N connection sections in the second part is greater than a total length of the P ground sections in the third part.

10. The communication device of claim 1, further comprising:

a matching circuit disposed between the first part and the signal source so that the first part is electrically connected to the signal source through the matching circuit.

* * * * *